US008321981B2

(12) United States Patent
Delneo et al.

(10) Patent No.: US 8,321,981 B2
(45) Date of Patent: Dec. 4, 2012

(54) HAMMER TACKER

(75) Inventors: John Delneo, Plantsville, CT (US); Robert Jennings, Waterbury, CT (US); Stephen Crosby, Broad Brook, CT (US); Thomas Pelletier, Wallingford, CT (US); Robert St. John, Cheshire, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 1048 days.

(21) Appl. No.: 11/476,737

(22) Filed: Jun. 29, 2006

(65) Prior Publication Data

US 2008/0000031 A1 Jan. 3, 2008

(51) Int. Cl.
*B26B 11/00* (2006.01)

(52) U.S. Cl. ..... 7/158; 30/162

(58) Field of Classification Search ..... 30/329, 30/1, 162; 7/144, 156, 160, 158
See application file for complete search history.

(56) References Cited

U.S. PATENT DOCUMENTS

| | | | | |
|---|---|---|---|---|
| 4,028,758 | A | 6/1977 | O'Connor | 7/14.1 R |
| 4,783,867 | A | 11/1988 | Tsao | 7/160 |
| 4,936,014 | A * | 6/1990 | Shaanan et al. | 30/162 |
| D321,637 | S | 11/1991 | Chan | D8/105 |
| 5,477,601 | A | 12/1995 | Jasmer | 29/417 |
| 5,852,840 | A | 12/1998 | Lapp | |
| 5,911,761 | A * | 6/1999 | Tilley | 7/160 |
| 6,047,427 | A * | 4/2000 | Whitlock et al. | 7/144 |
| 6,286,745 | B1 | 9/2001 | Ackeret | 227/76 |
| D463,494 | S | 9/2002 | Mori | D19/65 |
| 6,460,433 | B1 | 10/2002 | Ackeret et al. | 81/440 |
| 6,493,893 | B1 | 12/2002 | Ackeret | 7/160 |
| 6,550,660 | B1 * | 4/2003 | Chlebowski et al. | 227/133 |
| 6,823,592 | B1 * | 11/2004 | Rowe | 30/329 |
| 2001/0037528 | A1 * | 11/2001 | Ackeret | 7/160 |
| 2003/0088921 | A1 | 5/2003 | Ackeret | 7/160 |
| 2003/0106159 | A1 | 6/2003 | Ackeret et al. | 7/160 |
| 2004/0034937 | A1 | 2/2004 | Ackeret | 7/160 |
| 2006/0253996 | A1 | 11/2006 | Bianco | 7/160 |

FOREIGN PATENT DOCUMENTS

| | | |
|---|---|---|
| JP | 9-174459 | 7/1997 |
| JP | 2003-236267 | 8/2003 |
| WO | WO 03/074235 A1 | 9/2003 |

OTHER PUBLICATIONS

European Search Report issued for European Patent Application No. 07252490.3-1262, dated Nov. 2, 2007.
Notification of Reexamination as issued for Chinese Patent Application No. 200710127081.1, dated Jun. 12, 2012.

* cited by examiner

*Primary Examiner* — Jacob K Ackun
(74) *Attorney, Agent, or Firm* — Pillsbury Winthrop Shaw Pittman LLP

(57) ABSTRACT

A stapler capable of dispensing staples therefrom and comprising a head and a handle. The head comprises a staple dispenser configured to dispense a staple from the stapler when a compressive force is applied to the staple dispenser, and a blade carriage that carries a blade and is configured such that the blade is extendable from the head of the stapler and is retractable into the head of the stapler. The handle is attached to the head, and permits the stapler to be swung like a hammer to drive staples dispensed from the staple dispenser.

16 Claims, 11 Drawing Sheets

HAMMER TACKER

FIELD OF THE INVENTION

The invention relates to a stapler that includes a staple dispenser for dispensing staples and a blade carriage that secures a blade.

BACKGROUND OF THE INVENTION

Typically, staplers have a variety of uses in construction, manufacturing, and other fields. Many of these fields also call for at least occasional use of a knife or knives, such as a utility knife. However, past attempts to combine the functionality of a stapler with a knife have resulted in devices that are unwieldy to operate, particularly when switching between stapling and cutting.

SUMMARY

One aspect of the invention relates to a stapler. In one embodiment, the stapler comprises a head and a handle. The head comprises a staple dispenser configured to dispense a staple from the stapler when a compressive force is applied to the staple dispenser, and a blade carriage that carries a blade and is configured such that the blade is extendable from the head of the stapler and is retractable into the head of the stapler. The handle is attached to the head, and permits the stapler to be swung like a hammer to drive staples dispensed from the staple dispenser.

Another aspect of the invention relates to a stapler. In one embodiment, the stapler comprises a head and a handle. The head comprises a staple dispenser configured to dispense a staple from the stapler when a compressive force is applied to the staple dispenser, and a blade carriage that carries a blade and is configured such that the blade is extendable from the head of the stapler. The handle that extends from the head. In some instances, the staple dispenser and the blade carriage are provided by the head such that the user can switch between using the staple dispenser and the blade by rotating the stapler about an axis that extends longitudinally along the handle.

Another aspect of the invention relates to a stapler. In one embodiment, the stapler comprises a head and a handle. The head comprises a staple dispenser configured to dispense a staple from the stapler when a compressive force is applied to the staple dispenser, and a blade carriage that carries a blade, the blade carriage being movable within the head between a first carriage position at which the blade is extended from the head and a second carriage position at which the blade is retracted within the head. In some instances, the blade is removable from the blade carriage. The handle attached to the head, and permits the stapler to be swung like a hammer to drive staples dispensed from the staple dispenser.

DETAILED DESCRIPTION

Figure 1:
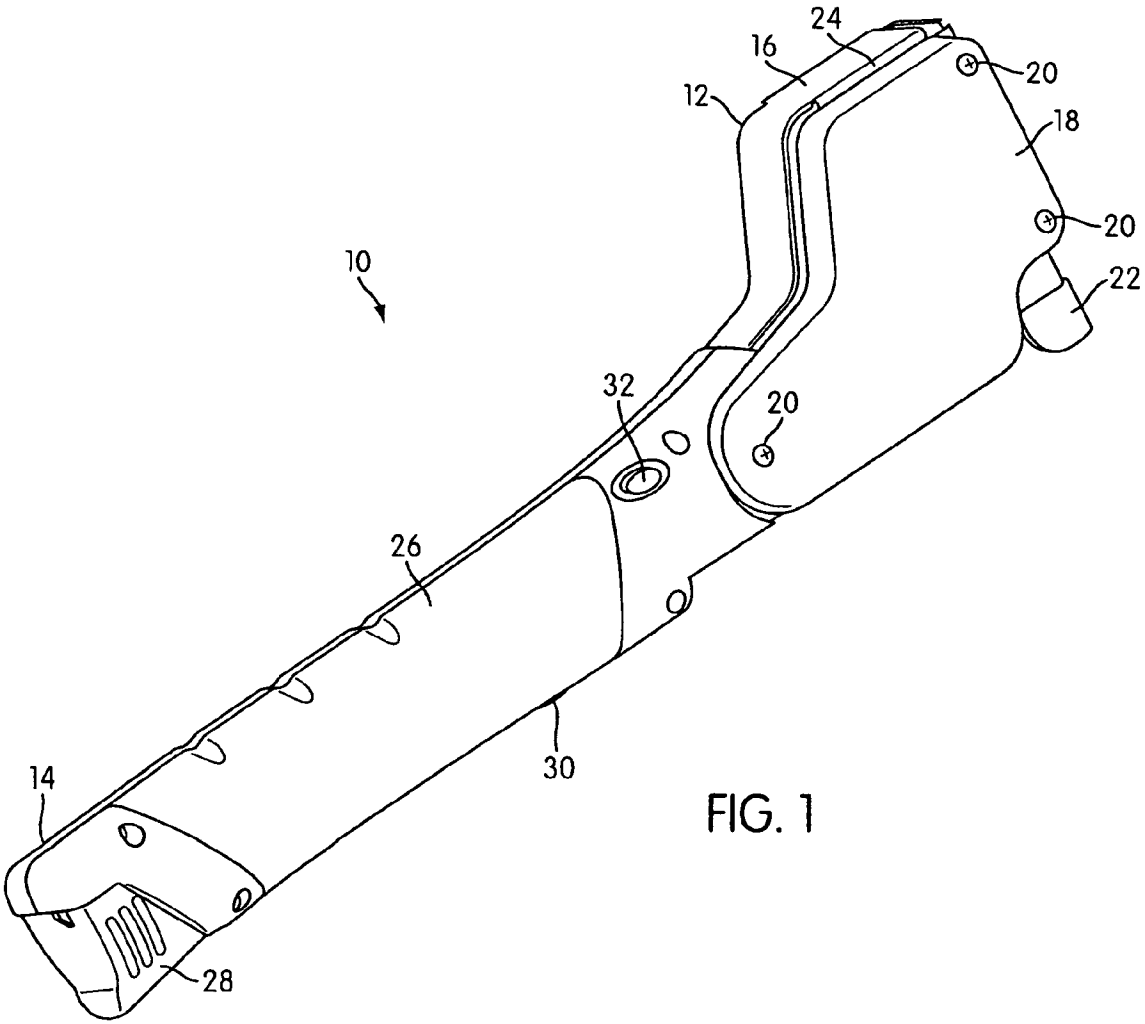
FIG. 1 illustrates a stapler, in accordance with one embodiment of the invention.

FIG. 1 is a perspective view of a stapler 10, according to one embodiment of the invention. Stapler 10 includes a head 12 and an elongated handle 14. Head 12 includes a head body 16 and an outer plate 18. Outer plate 18 is attached to head body 16 via one or more fasteners 20. Outer plate 18 is shaped so as to provide an outer housing on one side of head 12. On a side of head 12 adjacent to the side of outer plate 18, a staple dispenser 22 is provided. Staple dispenser 22 is configured to dispense a staple from stapler 10 when a compressive force is applied to staple dispenser 22. On a side of head 12 opposite from staple dispenser 22, outer plate 18 and head body 16 form a slot 24.

As can be seen in FIG. 1, handle 14 is attached to head 12 such that a user can grasp stapler 10 about handle 14 and swing stapler 10 like a hammer to drive staples dispensed from staple dispenser 22. Handle 14 includes a housing 26 that forms a grip for the user to grasp. Housing 26 protectively covers the inner-workings of handle 14. At an end of handle 14 opposite the attachment to head 12, a reloadable staple cartridge 28 is accessible. Reloadable staple cartridge 18 enables a supply of staples to be introduced into stapler 10, and holds the staples in place within handle 14 and head 12 such that the staples can be dispensed from staple dispenser 22. An actuator 30 is disposed on handle 14. In one embodiment, actuator 30 is disposed on handle 14 on the same side of stapler 10 as staple dispenser 22. A release mechanism 32 is disposed on handle 14 as well.

Figure 2:
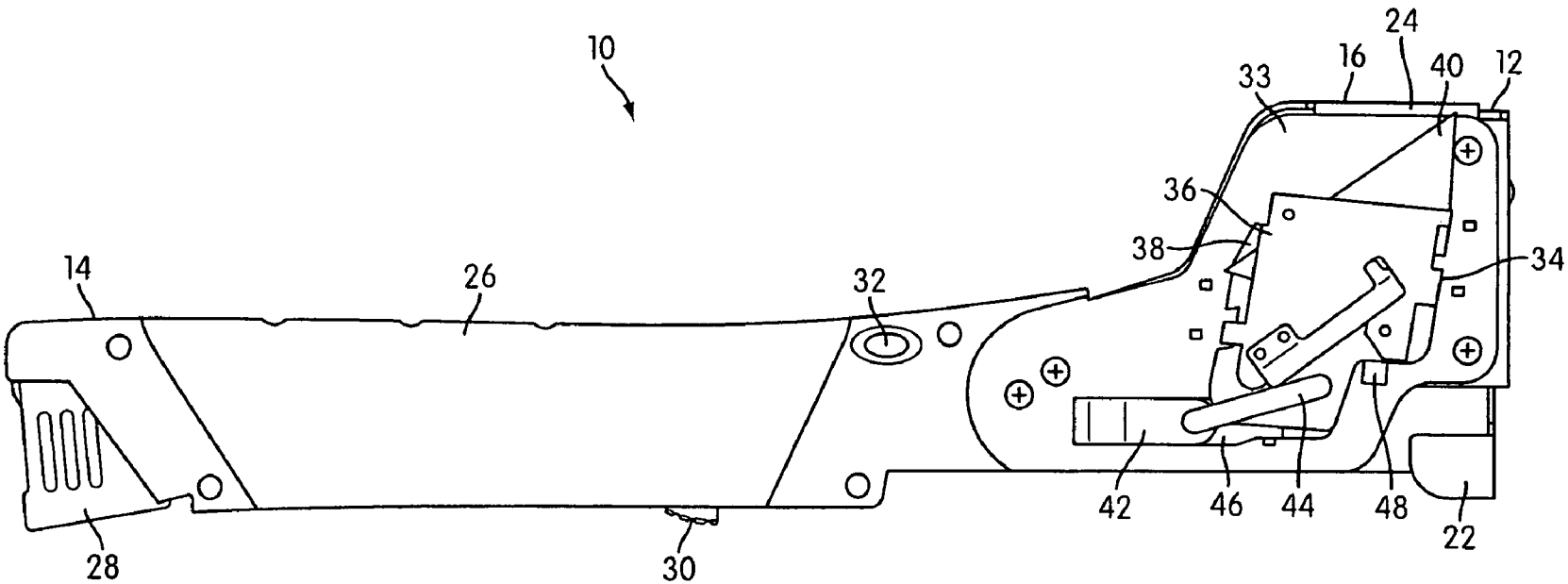
FIG. 2 illustrates the positioning of a blade carriage within a stapler, according to one embodiment of the invention.

FIG. 2 illustrates a side elevation of stapler 10 with outer plate 18 removed from head 12 to reveal a head body housing 33. As can be seen in FIG. 2, head 12 includes a blade carriage 34 disposed within head 12 between head body housing 33 and outer plate 18. Blade carriage 34 includes a pair of opposing plates 36 and 38 which hold a blade 40 securely therebetween. Blade carriage 34 is coupled to actuator 30 via a sliding element 42 that is connected to actuator 30 and a link 44 that is pivotally attached to each of blade carriage 34 and sliding element 42. Sliding element 42 is disposed within head body 16 and housing 26, and is visible in the view shown in FIG. 2 through an opening 46 in head body housing 33. Link 44 is coupled to sliding element 42 within head body housing 33, and extends out of head body housing 33, via opening 46.

In FIG. 2, blade carriage 34 is positioned at its default, or "rest," position. At the rest position of blade carriage 34, blade carriage 34 is seated on a carriage stop 48 that protrudes out from head body housing 33. Also, at the rest position of blade carriage 34, blade 40 is retracted within head 14.

Figure 3:
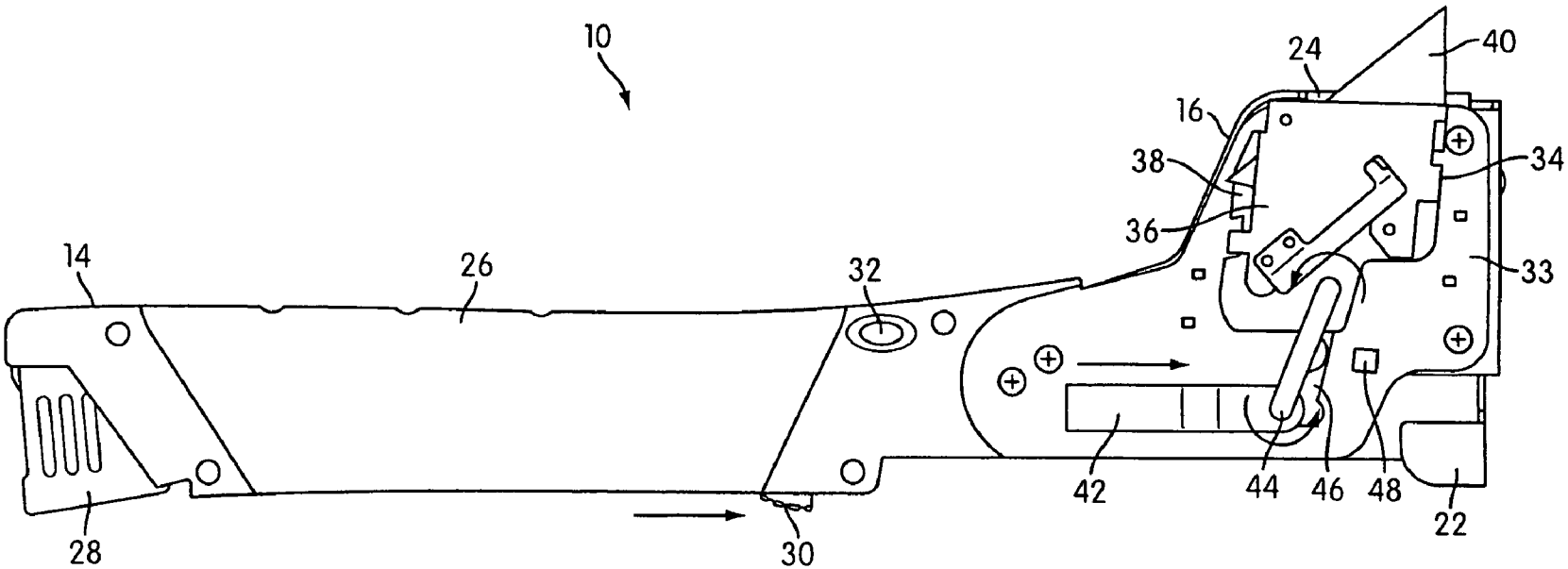
FIG. 3 illustrates the positioning of a blade carriage within a stapler, according to one embodiment of the invention.

Turning to FIG. 3, blade carriage 34 is movable within head 12 from the rest position shown in FIG. 2 to an "in use" position, at which blade carriage 34 is slid toward slot 24 between outer plate 18 and head body housing 33. At the in use position of blade carriage 34, blade 40 extends out of head 12 through slot 24 and can be used to cut material, or for other purposes suitable for a utility knife.

As is illustrated in FIG. 3, blade carriage 34 is actuable between the rest position shown in FIG. 2 and the in use position shown in FIG. 3 by engaging actuator 30. More specifically, if actuator 30 is engaged and driven along handle 14 toward head 12, sliding element 42 is also driven in the same direction within housings 26 and 33 (as is discussed further below), which in turn causes link 44 to thrust blade carriage toward slot 24 in the manner illustrated. When blade carriage 34 is positioned in the in use position, the user is able to use stapler 10 as a utility knife. As can be appreciated from FIG. 3, the configuration of staple dispenser 22 and slot 24 enable the user to switch between using staple dispenser 22 and blade 40 by simply rotating stapler 10 in the user's hand about an axis running longitudinally along handle 14 and engaging (or disengaging) actuator 30. Further, it can be seen that actuator 30 is provided to enable the user to conveniently engage actuator 30 with his thumb while using stapler 10 as a utility knife (e.g., with blade carriage 34 in the in use position).

Figure 4:
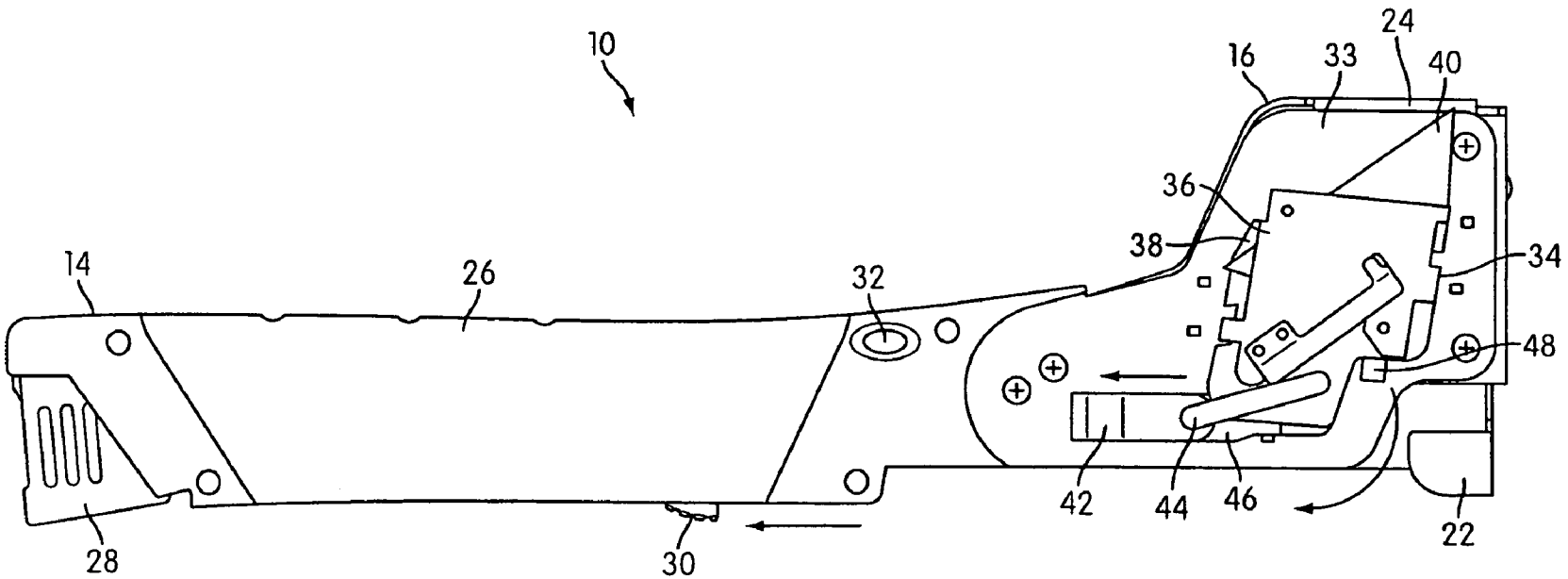
FIG. 4 illustrates the positioning of a blade carriage within a stapler, according to one embodiment of the invention.

FIG. 4 is an elevation view of stapler 10 with outer plate 18 removed that shows blade carriage 34 returning from the in use position to the rest position. More specifically, FIG. 4 shows that as actuator 30 is moved back along handle 14 away from head 12, sliding element 42 is likewise retracted back into handle 14, which causes link 44 to draw back to carriage stop 48, thereby retracting blade 40 back into head 12.

Figure 5:
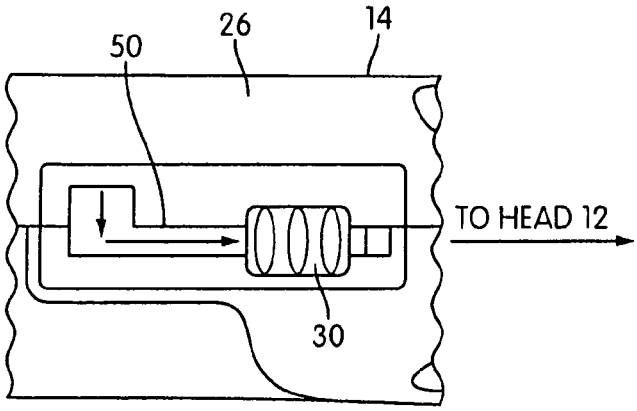
FIG. 5 illustrates an actuator disposed on a stapler, in accordance with one embodiment of the invention.

FIG. 5 illustrates a view of handle 14 that shows an opening 50 in handle housing 26 that forms a track for actuator 30. As can be seen in FIG. 5, opening 50 is L-shaped, with the long length of the "L" running longitudinally along handle 14. When actuator 30 is positioned at a first position located at the distal end of the short length of the "L," the sliding element 42 is retracted back into handle 14, and blade carriage 34 is positioned at the rest position. When the user engages actuator 30 and moves actuator 30 from the first position to a second position at the distal end of the long length of the "L" (the position shown in FIG. 5), sliding element 42 is actuated within handle 14 and head 12 and drives blade carriage 34 from the rest position to the in use position (as illustrated in FIG. 3). The "L" shape of opening 50 provides a safety mechanism in that when actuator 30 is at the first position, the use is not able to move actuator 30 by simply sliding actuator 30 longitudinally along handle 14 without first sliding actuator 30 transverse to handle 14.

Figure 6:
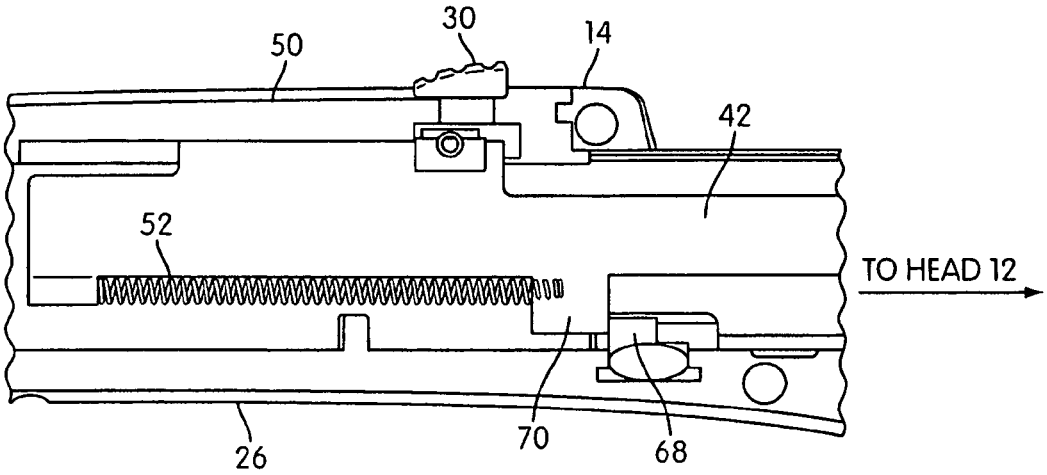
FIG. 6 illustrates the relationship between an actuator disposed on a handle of a stapler and a sliding element within the handle of the stapler, in accordance with one embodiment of the invention.

FIG. 6 is a sectional side elevation of handle 14 of stapler 10. The view shown in FIG. 6 illustrates the mechanical relationship between actuator 30 and sliding element 42. As can be seen, actuator 30 is directly attached to sliding element 42 such that anytime actuator 30 is moved, sliding element 42 is moved, and vice versa. Additionally, FIG. 6 shows a biasing mechanism 52 (e.g., a spring, etc.) that is attached to sliding element 42 at an attachment point 54. Biasing mechanism 52 applies a bias to sliding element 42 away from head 12. This bias applied by biasing mechanism 52 also effectively biases actuator 30 into the first position described above, and biases blade carriage 34 into the rest position (shown in FIG. 2), by virtue of the couples between sliding element 42 and actuator 30, and sliding element 42 and blade carriage 34, respectively. Although not shown in FIG. 6, the end of biasing mechanism 52 opposite the end that is attached to sliding element 42 is attached to housing 26.

Figure 7:
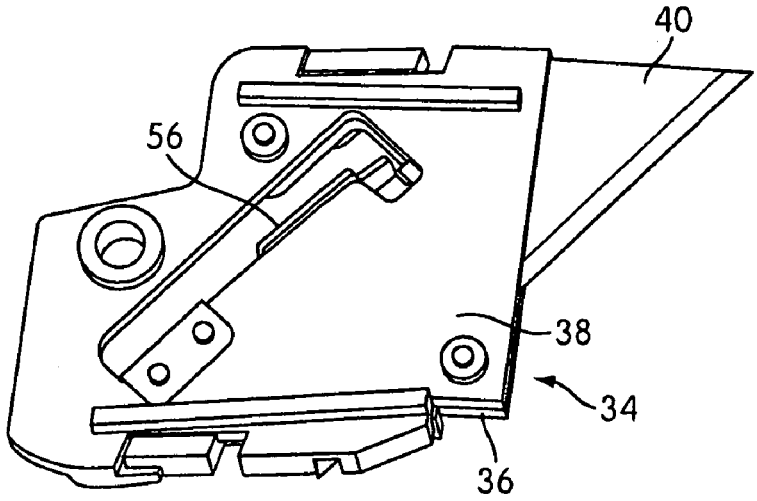
FIG. 7 illustrates a blade carriage, according to one embodiment of the invention.

FIG. 7 illustrates a perspective view of blade carriage 34 and blade 40. More particularly, FIG. 7 illustrates a reverse view of blade carriage 34 from the views shown in FIGS. 2-4 (i.e., in FIG. 7, plate 38 is shown as the outer plate). As can be seen in FIG. 7, blade carriage 34 includes a release tab 56 formed as a ridge extending outward from plate 38 at an angle substantially perpendicular to plate 38. As is discussed further below, release tab 56 operates as a trigger that, when actuated, frees blade from engagement with blade carriage 34 such that blade 40 can be removed (and/or replaced) from between plates 36 and 38 when a force is applied to release tab 56 in a direction away from blade 40.

Figure 8:
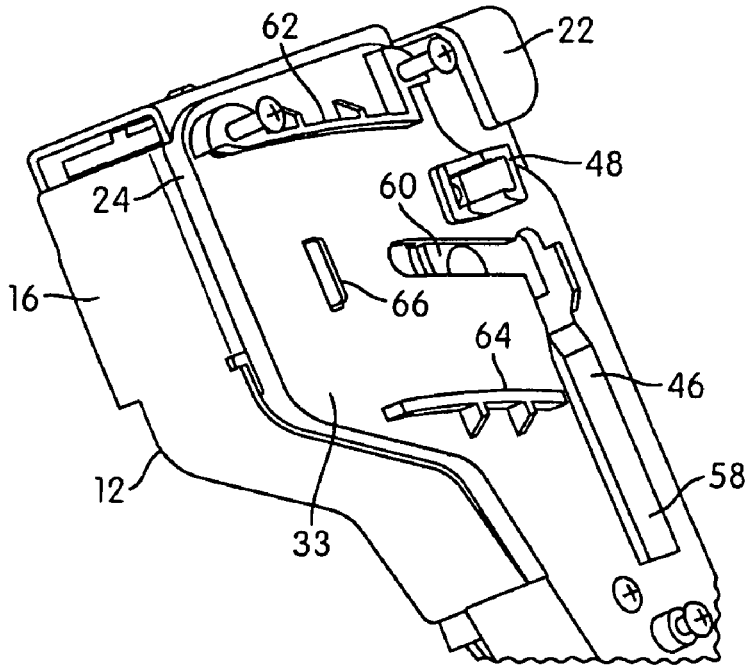
FIG. 8 illustrates a head of a stapler, in accordance with one embodiment of the invention.

FIG. 8 shows a more detailed view of the outer surface of head body housing 33, with outer plate 18 and blade carriage 34 removed. As can be seen, opening 46 is formed with a first portion 58 that extends in a direction that is generally parallel with handle 14, and a second portion 60 that runs transverse to handle 14 and generally in the direction of the path of blade carriage 34 between the rest position and the in use position described above (and shown in FIGS. 2-4). The shape and directions of portions 58 and 60 of opening 46 enable link 44 to guide blade carriage 34 between the rest and in use positions in response to the movement of sliding element 42 within housings 26 and 33. FIG. 8 also illustrates a pair of guide ridges 62 and 64 that protrude out from the surface of head body housing 33. Guide ridges 62 and 64 define the path of blade carriage 34 between the rest and in use positions, and serve to guide blade carriage between outer plate 18 and head body housing 33. A release ridge 66 also protrudes out from the surface of head body housing 33. As will be described in greater detail below, release ridge 66 is configured to engage release tab 56 of blade carriage 34 to enable the user to remove (and/or replace) blade 40.

Figure 9:
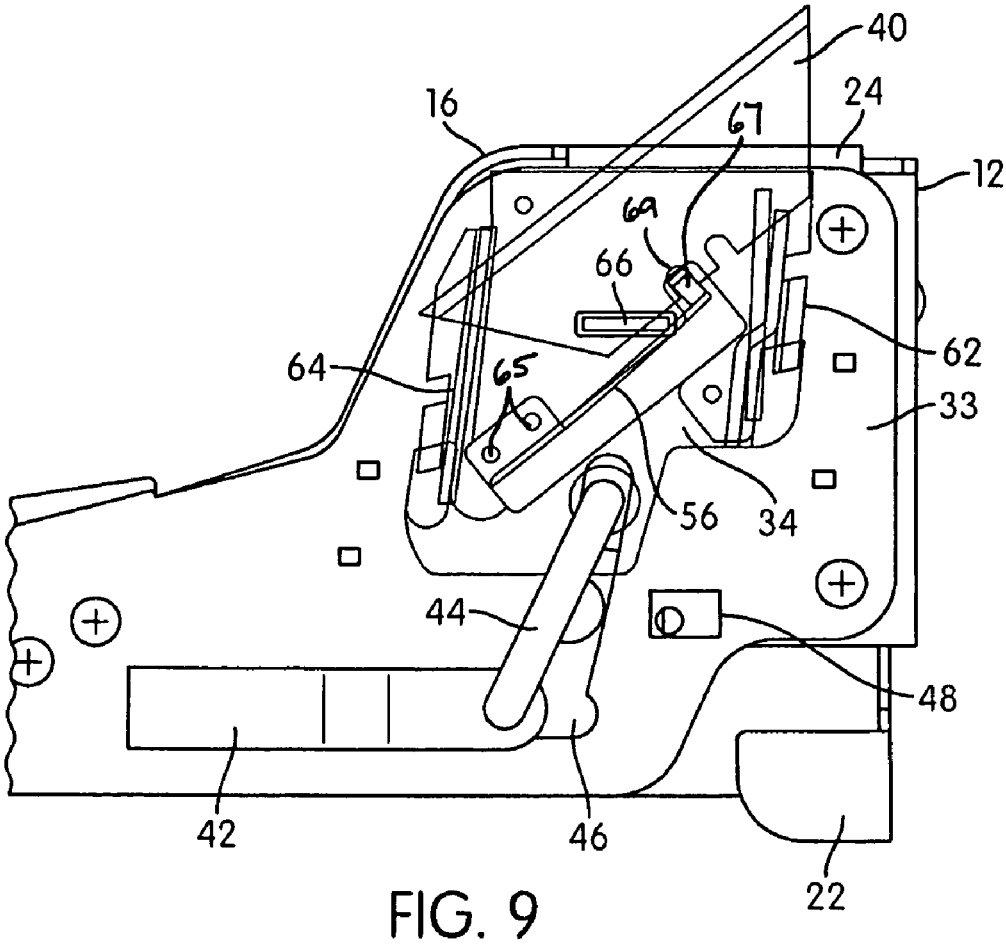
FIG. 9 illustrates the positioning of a blade carriage within a stapler, according to one embodiment of the invention.

FIG. 9 is an elevation view of head 12 with outer plate 18 removed, and showing blade carriage 34 and blade 40 as transparent objects, in order to illustrate various mechanisms of operation of stapler 10. In the view shown in FIG. 9, blade carriage 34 is positioned between guide ridges 62 and 64 in the in use position, with blade 40 extending out of head 12 at slot 24. As can be seen, in this position release tab 56 of blade carriage 34 stops just short of engaging release ridge 66 such that release ridge 66 is displaced with respect to blade carriage 34. However, opening 46 is formed to allow sliding element 42 to slide further into head 12 from its position when blade carriage 34 is in the in use position. This would in turn drive blade carriage 34 further away from the rest position and further toward slot 24. Additionally, returning briefly to FIGS. 5 and 6, it can be seen that when actuator 30 is located at the second position within opening 50 (as described above), opening 50 is formed to enable the user to move actuator 30 still further toward head 12. Coming back now to FIG. 9, by moving actuator 30 out of the second position shown in FIGS. 5 and 6, and further toward head 12, sliding element 42 is slid further into head 12.

Figure 10:
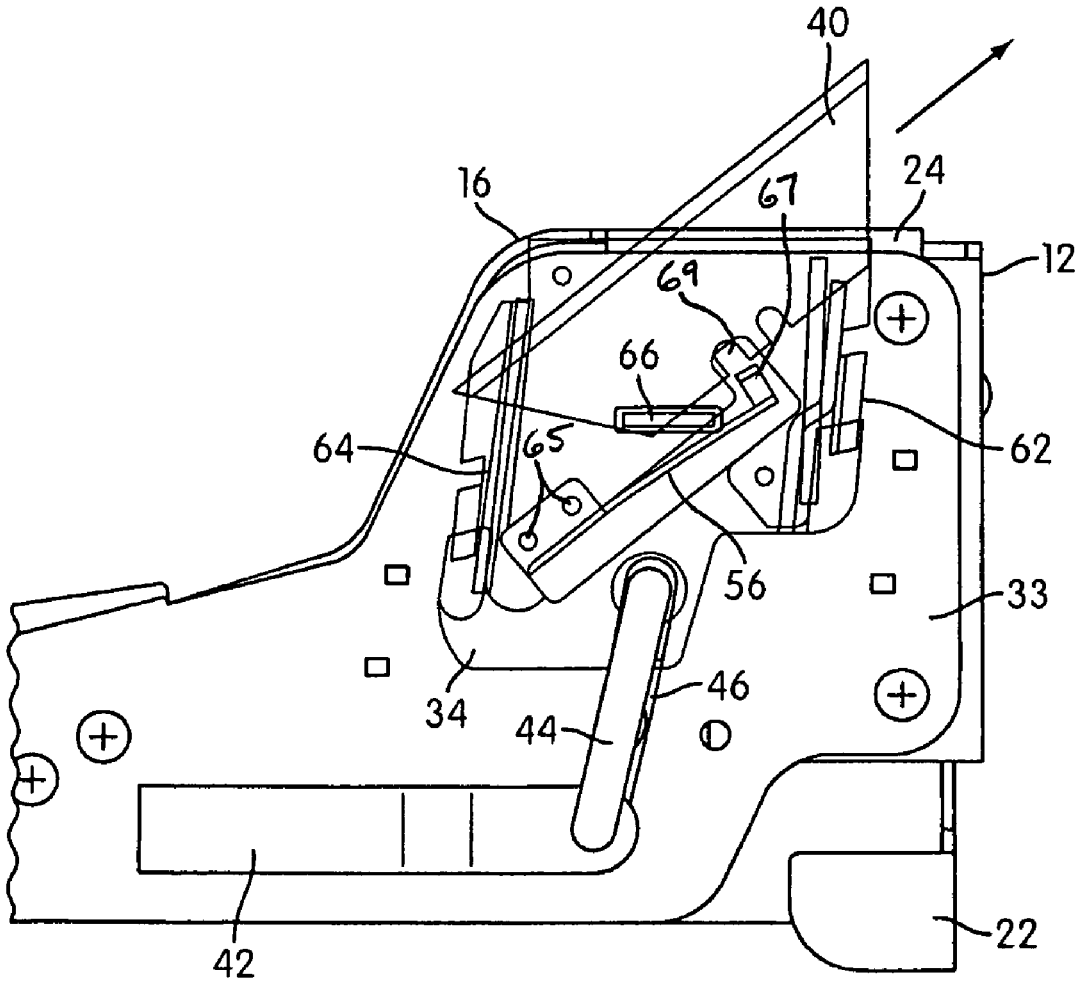
FIG. 10 illustrates the positioning of a blade carriage within a stapler, according to one embodiment of the invention.

By way of illustration, FIG. 10 shows an elevation view of head 12 similar to that of FIG. 9. However, in the depiction of stapler 10 shown in FIG. 10, sliding element 42 has been slid to edge of portion 58 of opening 46. As can be seen, this drives blade carriage 34 to a blade release position where blade carriage 34 is thrust further toward slot 24 than when blade carriage 34 is in the in use position of FIG. 9. As shown in FIG. 10, moving blade carriage 34 to this blade release position causes release ridge 66 to engage release tab 56 of blade carriage 34 with enough force to displace release ridge 66 with respect to blade carriage 34.

As was mentioned above, this effectuates the release of blade 40 from blade carriage 34. More particularly, release ridge 66 is formed from a resiliently flexible material, such as spring steel for instance, and is fixed to plate 38 in a cantilevered arrangement by one or more fasteners 65. At an end of release ridge 66 opposite from the end that is fixed to plate 38 by fasteners 65, a protrusion 67 extends into a blade slot 69 formed in blade 40. The interlocking relationship of protrusion 67 with slot 69 retains blade 40 within blade carriage 34. The engagement between release ridge 66 and release tab 56 causes release ridge 66 to flex about the engagement between release ridge 66 and plate 38 such that protrusion 67 is removed from slot 69, thereby freeing blade 40 to be removed from and/or replaced in blade carriage 34 by the user through slot 24.

Figure 11:
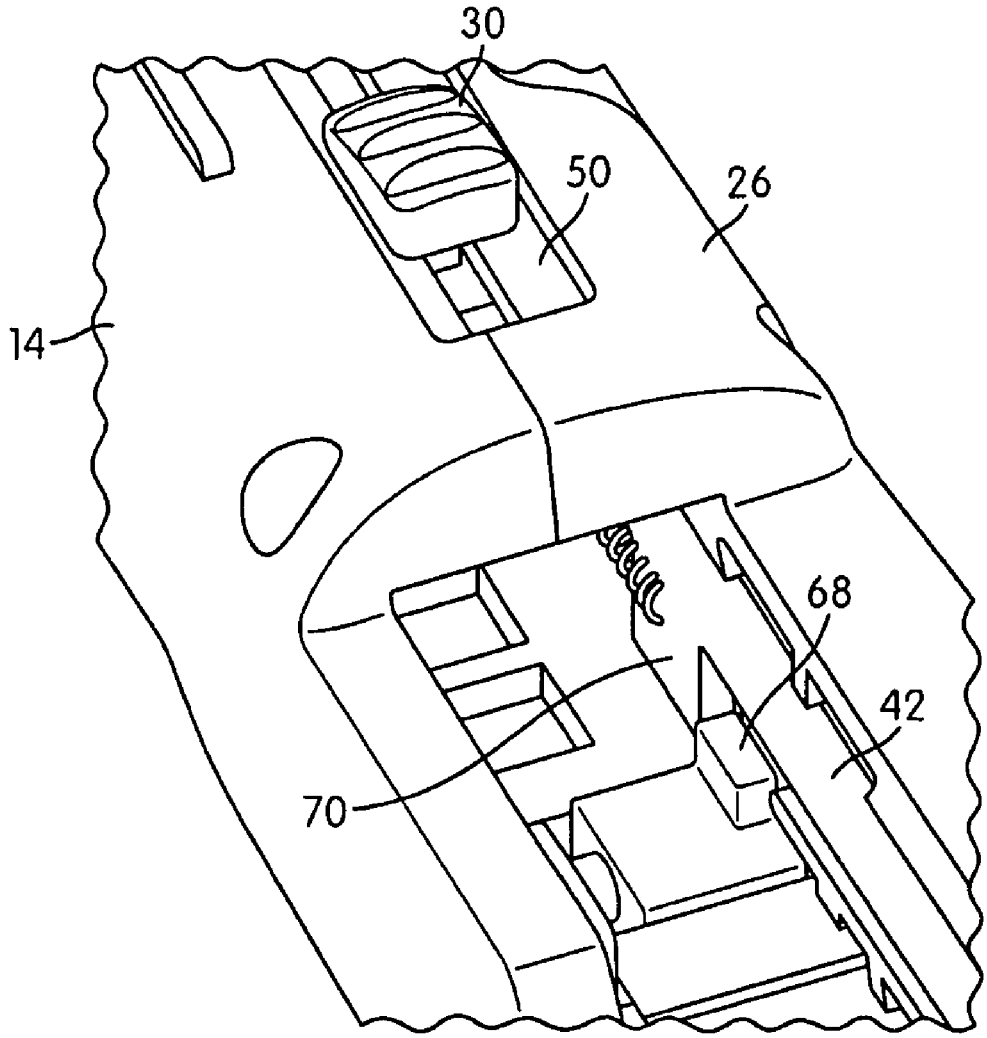
FIG. 11 illustrates the operation of a safety mechanism of a stapler, in accordance with one embodiment of the invention.

In order to guard against the user inadvertently moving blade carriage 34 from the in use position shown in FIG. 9 to the blade release position shown in FIG. 10, stapler 10 includes a safety mechanism. The operation of this mechanism is illustrated in the perspective view of FIG. 11. In FIG. 11, handle 14 is depicted with a portion of housing 26 removed to reveal a movable stop 68. Stop 68 is configured to be movable between a stop position and a release position. FIG. 11 shows stop 68 in stop position, where stop 68 engages a flange 70 formed on sliding element 42 when blade carriage 34 is in the in use position (shown, e.g., in FIG. 9). The engagement between stop 68 and flange 70 impedes further movement of sliding element 42 toward head 12 that would drive blade carriage 34 to the blade release position (shown in FIG. 10) in the manner described above.

Figure 12:
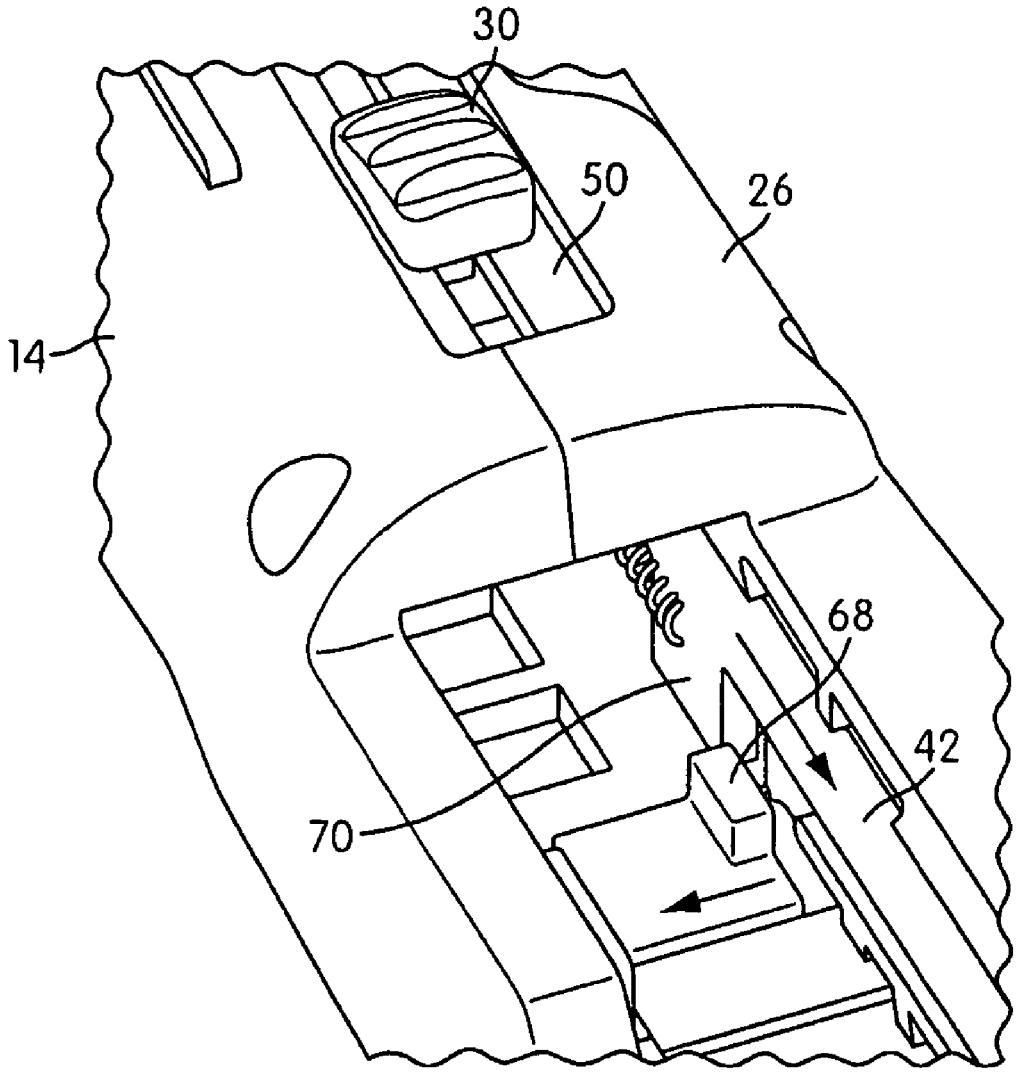
FIG. 12 illustrates the operation of a safety mechanism of a stapler, in accordance with one embodiment of the invention.

FIG. 12 illustrates the movement of stop 68 from the stop position to the release position. At the release position stop 68 is displaced toward the center of handle 14 such that stop 58 clears flange 70, thereby enabling sliding element 42 to slide further toward head 12 and drive blade carriage 34 from the in use position to the blade release position. The movement of stop 68 from the stop position, which is the default position of stop 68, to the release position is accomplished by the user by engaging release mechanism 32 (see FIG. 1) and pressing release mechanism 32 into handle 14. In one embodiment, release mechanism 32 is directly coupled to stop 68.

Figure 13:
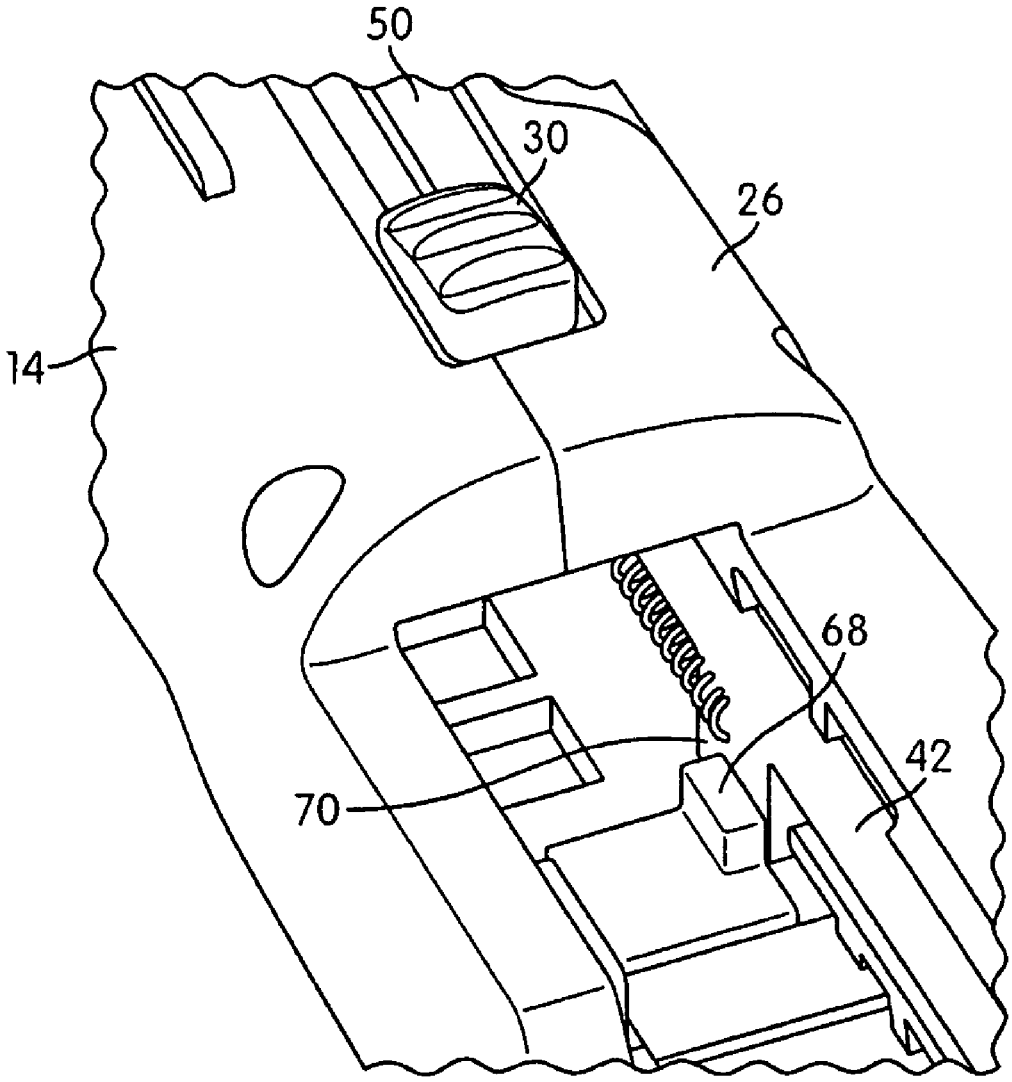
FIG. 13 illustrates the operation of a safety mechanism of a stapler, in accordance with one embodiment of the invention.

As was stated above, the movement of stop 68 to the release position enables sliding element 42 to slide further toward head 12. This is illustrated further in FIG. 13. As can be seen in FIG. 13, as sliding element 42 is driven further toward head 12, flange 70 comes along side of stop 68 and holds stop 68 in the stop position until sliding element 42 returns to the position shown in FIG. 11, at which point, stop 68 returns to its default position (the stop position).

It can thus be appreciated that embodiments of the present invention have now been fully and effectively accomplished. The foregoing embodiments have been provided to illustrate the structural and functional principles of the present invention, and are not intended to be limiting. To the contrary, the present invention is intended to encompass all modifications, alterations and substitutions within the spirit and scope of the appended claims.

What is claimed is:

1. A stapler comprising:

a head, the head comprising:

a staple dispenser configured to dispense a staple from the stapler in a first direction when a compressive force is applied to the staple dispenser; and a blade carriage that carries a blade and is configured such that the blade is extendable from the head of the stapler and is retractable into the head of the stapler; and a handle attached to the head that permits the stapler to be swung, generally along a swing plane, like a hammer to drive staples dispensed from the staple dispenser, wherein the blade extends from the head in a second direction, the second direction being substantially opposite from the first direction such that the blade and the cutting edge thereof extend generally within a cutting plane that is co-planar with or parallel to the swing plane; and an actuator that is (i) coupled to the blade carriage, (ii) disposed on the handle, and (iii) is configured such that the retraction and extension of the blade with respect to the head is controllable by engaging the actuator.

2. The stapler of claim 1, wherein the actuator is movable between a first actuator position and a second actuator position, and wherein if the actuator is in the first actuator position the blade is retracted within the head and if the actuator is in the second actuator position the blade is extended from the head.

3. The stapler of claim 1, wherein the blade is removable from the blade carriage.

4. The stapler of claim 1, wherein the staple dispenser is disposed on a first side of the head, and wherein the blade carriage is configured such that the blade is extendable from the head of the stapler from a second side of the head opposite from the first side, wherein the blade is extendable from the head of the stapler transverse to a plane formed by the second side of the head.

5. The stapler of claim 1, wherein the blade carriage is movable between a first carriage position at which the blade is retracted within the head of the staple and a second carriage position at which the blade is extended from the head.

6. The stapler of claim 5, wherein a default position of the blade carriage is the first carriage position.

7. A stapler comprising:

a head, the head comprising:

a staple dispenser configured to dispense a staple from the stapler in a first direction when a compressive force is applied to the staple dispenser; and a blade carriage that carries a blade and is configured such that the blade is extendable from the head of the stapler in a second direction that is substantially opposite from the first direction;

a handle that extends from the head;

wherein the staple dispenser and the blade carriage are provided by the head such that the user can switch between using the staple dispenser on a fixed, planar surface and using the blade on the same fixed, planar surface by rotating the stapler approximately 180 degrees about an axis that extends longitudinally along the handle, wherein the blade carriage is configured such that the blade is retractable into the head when the blade is not in use; and an actuator that is (i) coupled to the blade carriage, (ii) disposed on the handle, and (iii) is configured such that the retraction and extension of the blade with respect to the head is controllable by engaging the actuator.

8. The stapler of claim 7, wherein the staple dispenser is provided by the head on a first side of the stapler, and wherein the actuator is disposed on the handle on the first side of the stapler.

9. The stapler of claim 7, wherein the actuator is movable between a first actuator position and a second actuator position, and wherein if the actuator is in the first actuator position the blade is retracted within the head and if the actuator is in the second actuator position the blade is extended from the head.

10. The stapler of claim 7, wherein the blade is removable from the blade carriage.

11. The stapler of claim 7, wherein the staple dispenser is disposed on a first side of the head, and wherein the blade carriage is configured such that the blade is extendable from the head of the stapler from a second side of the head opposite from the first side, wherein the blade is extendable from the head of the stapler transverse to a plane formed by the second side of the head.

12. A stapler comprising:

a head, the head comprising:

a staple dispenser configured to dispense a staple from the stapler when a compressive force is applied to the staple dispenser; and a blade carriage that carries a blade, the blade carriage being movable within the head between a first carriage position at which the blade is extended from the head and a second carriage position at which the blade is retracted within the head, and wherein the blade is removable from the blade carriage; and a handle, the handle having an actuator thereon that is coupled to the blade carriage such that movement of the blade carriage between the first carriage position and the second carriage position is controlled by movement of the actuator between first and second actuator positions, wherein the handle is joined with the head to permit the stapler to be swung like a hammer to drive staples dispensed from the staple dispenser.

13. The stapler of claim 12, wherein the staple dispenser is disposed on a first side of the head, and wherein the blade carriage is configured such that when the blade carriage is at the first carriage position the blade is extends from the head of the stapler from a second side of the head opposite from the first side, wherein the blade is extendable from the head of the stapler transverse to a plane formed by the second side of the head.

14. The stapler of claim 12, wherein the default position of the blade carriage is the second carriage position.

15. The stapler of claim 12, wherein if the actuator is in the first actuator position the blade carriage is positioned at the first carriage position and if the actuator is in the second actuator position the blade carriage is positioned at the second carriage position.

16. The stapler of claim 12, wherein the staple dispenser dispenses staples from the head of the stapler in a first direction, and the blade is extendable from the head of the stapler in a second direction if the blade carriage is at the first carriage position, and wherein the second direction is substantially opposite the second direction.

* * * * *